US012202578B1

(12) United States Patent
Magloire

(10) Patent No.: US 12,202,578 B1
(45) Date of Patent: Jan. 21, 2025

(54) VENTILATED BOAT KEEL

(71) Applicant: Danny Magloire, Port St Lucie, FL (US)

(72) Inventor: Danny Magloire, Port St Lucie, FL (US)

( * ) Notice: Subject to any disclaimer, the term of this patent is extended or adjusted under 35 U.S.C. 154(b) by 530 days.

(21) Appl. No.: 17/565,193

(22) Filed: Dec. 29, 2021

(51) Int. Cl.
*B63B 3/38* (2006.01)
*B63B 1/04* (2006.01)

(52) U.S. Cl.
CPC ..... *B63B 3/38* (2013.01); *B63B 1/042* (2013.01)

(58) Field of Classification Search
CPC ..... B63B 3/38; B63B 1/042; B63B 1/38
USPC ..... 114/67 A
See application file for complete search history.

(56) References Cited

U.S. PATENT DOCUMENTS

| | | | | |
|---|---|---|---|---|
| 4,231,314 | A * | 11/1980 | Peters | B63B 1/38 114/291 |
| 4,989,534 | A * | 2/1991 | Field | B63B 1/18 114/67 A |
| 6,672,234 | B2 | 1/2004 | Osmundsvaag | |
| 6,868,798 | B2 * | 3/2005 | Robinson | B63B 1/38 114/291 |
| 10,246,162 | B2 | 4/2019 | Matthews et al. | |

* cited by examiner

*Primary Examiner* — Stephen P Avila
(74) *Attorney, Agent, or Firm* — Sanchelima & Associates, P.A.; Jesus Sanchelima; Christian Sanchelima

(57) ABSTRACT

A boat hull having a ventilated boat keel is disclosed. In one embodiment, the ventilated boat keel may be a longitudinal vent tube from bow to stern, which runs down the center of the hull and branches off into multiple vent openings along the stepped hull. In another embodiment, the ventilated boat keel may be a longitudinal vent tube from bow to stern, which runs down the center of the hull and branches off into multiple vent openings along a traditional hull design. The ventilated boat keel creates a layer of micro-bubbles along the bottom of the boat. The micro-bubbles reduce friction and drag and allow for the boat to travel at a higher rate of speed using less fuel.

12 Claims, 3 Drawing Sheets

VENTILATED BOAT KEEL

BACKGROUND OF THE INVENTION

1. Field of the Invention

The present invention relates to a ventilated boat keel and, more particularly, to a ventilated boat keel that is mounted at the middle of a boat hull, and has a longitudinal vent tube which runs down the center of the hull, wherein the longitudinal vent tube branches off into multiple vent openings along the boat keel to travel at a higher rate of speed using less fuel.

2. Description of the Related Art

Several designs for boat hulls having boat keels have been designed in the past. None of them, however, include a longitudinal vent tube which runs down the center of the hull and branches off into multiple vent openings along the boat hull.

Applicant believes that a related reference corresponds to U.S. Pat. No. 10,246,162 issued for a boat hull comprising a longitudinally vented transverse step. Applicant believes that another related reference corresponds to U.S. Pat. No. 6,672,234 issued for a boat hull and keel which is designed to create an air cushion on the bottom of the boat while traveling. However, they differ from the present invention because the none of them have a longitudinal vent tube which runs down the center of the hull and branches off into multiple vent openings along the boat hull for creating a layer of micro-bubbles along the bottom of the boat wherein the micro-bubbles reduce friction and drag and allow for the boat to travel at a higher rate of speed using less fuel.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a boat hull with a boat keel to increase the volume of air that reaches the center by creating a negative cavity in the surface and then venting it.

It is another object of this invention to provide a boat hull with a boat keel that creates a layer of micro-bubbles along the bottom of the boat wherein the micro-bubbles reduce friction and drag.

It is still another object of the present invention to provide a boat hull with a boat keel that allows a boat to travel at high speeds consuming less fuel.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
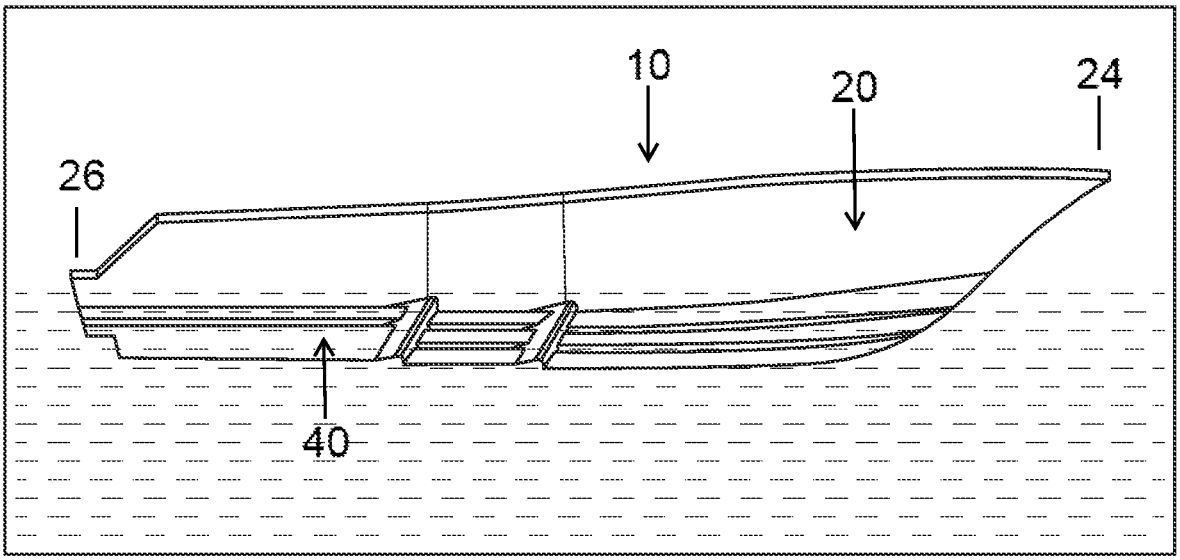
FIG. 1 represents an isometric operational view of a boat navigating on water, showing boat hull assembly 20 and the boat keel assembly 40 according to one embodiment of the present invention 10.
Figure 2:
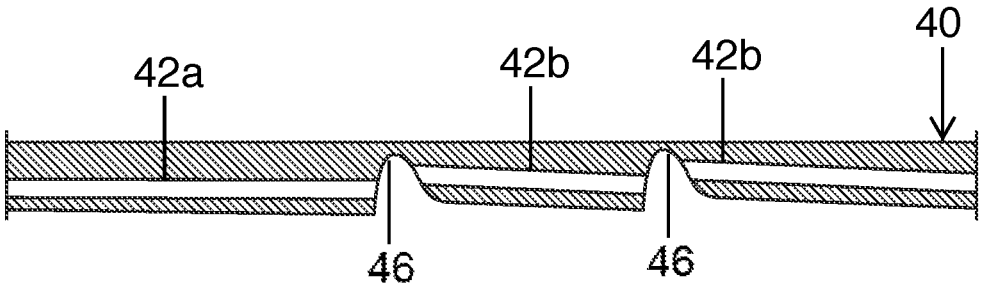
FIG. 2 shows a cross-sectional view of an orthogonal plane at the middle of a boat showing the boat keel assembly 40 having the longitudinal member 42, and the vent tubes 46.
Figure 3:
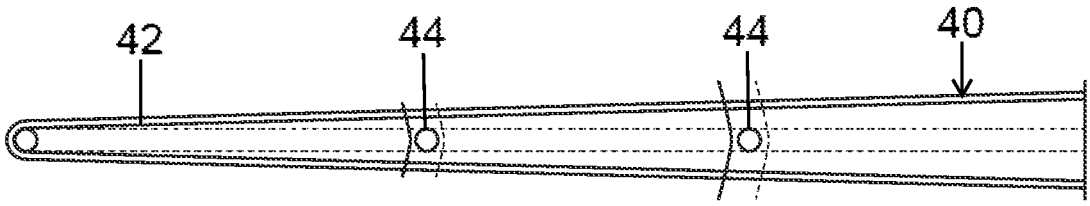
FIG. 3 illustrates a bottom view of a boat showing the boat keel assembly 40 with the longitudinal member 42 having the series of openings 44.
Figure 4:
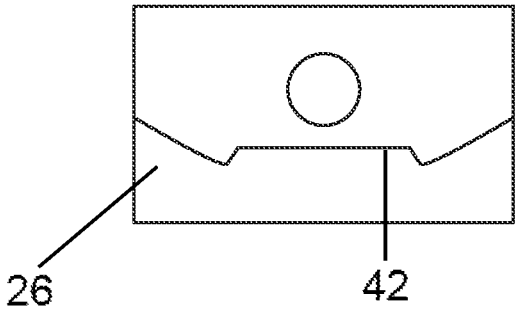
FIG. 4 is a representation a rear view of a boat showing the bow 26 wherein the end of the boat keel assembly 40 is seen.
Figure 5:
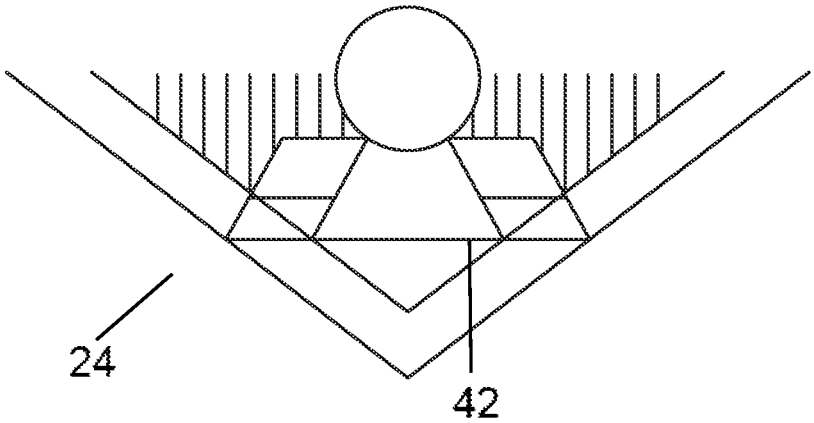
FIG. 5 shows a front view of a boat showing the stern 24 wherein the front of the boat keel assembly 40 is seen.

Referring now to the drawings, where the present invention is generally referred to with numeral 10, it can be observed that it basically includes a boat hull assembly 20 and a boat keel assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Best shown in FIG. 1 a boat including a boat hull assembly 20 having a boat keel assembly 40. The boat hull assembly 20 having a hull 22, wherein said hull 22 may be a traditional hull design or a stepped hull design. The hull 22 may come in different shapes such as round-bottom, flat-bottom, V-shape, multi-hulled or any other variation thereof. The boat hull assembly 20 may also have a bow 24 and a stern 26. The bow 24 is the front of the boat and the stern 26 is the back of the boat.

Best shown in FIGS. 1-4 the boat keel assembly 40 includes a stepped keel with at least two longitudinal members 42 having a first longitudinal member 42*a* and a second longitudinal member 42*b*, wherein said two longitudinal members 42 may be tubes having different profile shapes such as circular, rectangular or any other variation thereof. The longitudinal members 42 may be made of fiberglass, wood, plastic, aluminum or any other variation thereof. The longitudinal members 42 may be made of the same material as the boat hull assembly 20. The first longitudinal member 42*a* and the second longitudinal member 42*b* may have two opposing distal ends. The longitudinal members 42 may be mounted inline, unevenly and in a descendent order, wherein a portion of one distal end of the opposing distal ends of the first longitudinal member 42*a* meets with a portion of another distal end of the opposing distal ends of the second longitudinal member 42*b*. It should be understood that the longitudinal members 42 are not restricted to two longitudinal members. In one embodiment, the longitudinal members 42 may be three longitudinal members, the first longitudinal member 42*a*, the second longitudinal member 42*b* and a third longitudinal member 42*c*. Furthermore, throughout the length of the longitudinal members 42, a series of openings 44 may be mounted at a space a part relationship between each other, inline and centered of the longitudinal members 42. The series of openings 44 may have a substantially cylindrical shape. Vent tubes 46 may be mounted onto said series of openings 44. Said vent tubes 46 may also have a substantially cylindrical shape to conform to the series of openings 44. At least one vent tube 46*a* from the vent tubes 46 may be mounted between one distal end of the first longitudinal member 42*a* and another distal end of the second longitudinal member 44*b* at a point where the longitudinal members 42 meet. The vent tubes 46 may be made fiberglass, wood, plastic, aluminum or any other variation thereof. The vent tubes 46 are placed at an angle from the longitudinal member 42. The angle may vary from zero to ninety degrees, thus creating a layer of micro-bubbles along the bottom of a boat, wherein the micro-bubbles reduce friction and drag and allow for a boat to travel at a higher rate of speed using less fuel, therefore increasing fuel efficiency. As a boat speeds along the water, the boat keel assembly 40 helps to keep the bow 26 of the boat down so that it travels more efficiently through the water. The boat keel assembly 40 can be a separate piece that can be retrofitted onto stepped boat hulls. It may be suitable for the boat keel assembly to be retrofitted or integrally formed onto a catamaran hull, a stepped catamaran hull, a sail boat hull, a V-bottom boat hull, or any variation thereof.

In an alternative embodiment where a boat has a traditional boat hull assembly 20, the boat keel assembly 40 includes a longitudinal member 42, wherein said longitudinal member 42 may be a tube having different profile shapes such as circular, rectangular or any other variation thereof. The longitudinal member 42 may be made of fiberglass, wood, plastic, aluminum or any other variation thereof. The longitudinal member 42 may be made of the same material as the boat hull assembly 20. The longitudinal member 42 may run from the bow 24 to the stern 26. Furthermore, throughout the length of the longitudinal member 42, a series of openings 44 may be mounted at a space a part relationship between each other, inline and centered of the longitudinal member 42. The series of openings 44 may have a substantially cylindrical shape. Vent tubes 46 may be mounted onto said series of openings 44. Said vent tubes 46 may also have a substantially cylindrical shape to conform to the series of openings 44. The vent tubes 46 may be made fiberglass, wood, plastic, aluminum or any other variation thereof. The vent tubes 46 are placed at an angle from the longitudinal member 42. The angle may vary from zero to ninety degrees, thus creating a layer of micro-bubbles along the bottom of a boat, wherein the micro-bubbles reduce friction and drag and allow for a boat to travel at a higher rate of speed using less fuel, therefore increasing fuel efficiency. As a boat speeds along the water, the boat keel assembly 40 helps to keep the bow 26 of the boat down so that it travels more efficiently through the water. The boat keel assembly 40 can be a separate piece that can be retrofitted onto traditional boat hulls.

In one embodiment, the boat keel assembly 40 may be used and made for a power boat. Nonetheless, it should be understood that the boat keel assembly 40 may be used in any kind of boats such as a sailing boat, a slow-moving boat, a personal watercraft or any other variations thereof.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a ventilated boat keel, comprising:

a) a boat hull assembly; and b) a boat keel assembly including a stepped keel having at least two longitudinal members, a first longitudinal member and a second longitudinal member, running from a bow to a stern of the boat hull assembly, wherein the first longitudinal member and the second longitudinal member have a series of openings throughout the length of said longitudinal members, furthermore, the stepped keel includes vent tubes mounted to said series of openings; wherein said series of openings are placed inline at a space apart relationship between each other; wherein said vent tubes are made of the same material as said first longitudinal member and said second longitudinal member.

2. The system for a ventilated boat keel of claim 1, wherein said at least two longitudinal members are made of the same material as the boat hull assembly.

3. The system for a ventilated boat keel of claim 1, wherein said series of openings having a substantially circular profile shape.

4. The system for a ventilated boat keel of claim 1, wherein said vent tubes are mounted at an angle from zero to ninety degrees from said first longitudinal member and said second longitudinal member onto said series of openings.

5. The system for a ventilated boat keel of claim 1, wherein said vent tubes have a substantially cylindrical shape.

6. The system for a ventilated boat keel of claim 1, wherein at least one vent tube of said vent tubes is mounted between one distal end of the first longitudinal member and another distal end of the second longitudinal member at a point where said first longitudinal member and said second longitudinal member meet.

7. The system for a ventilated boat keel of claim 1, wherein the boat keel assembly is formed integrally onto a catamaran hull.

8. The system for a ventilated boat keel of claim 1, wherein the boat keel assembly is formed integrally onto a stepped catamaran hull.

9. The system for a ventilated boat keel of claim 1, wherein the boat keel assembly is formed integrally onto a sail boat hull.

10. The system for a ventilated boat keel of claim 1, wherein the boat keel assembly is formed integrally onto a V-bottom boat hull.

11. A system for a ventilated boat keel, consisting essentially of:

a) a boat hull assembly; and b) a boat keel assembly including a stepped keel having at least two longitudinal members, a first longitudinal member and a second longitudinal member running from a bow to a stern of the boat hull assembly, said first longitudinal member and said second longitudinal member are made of the same material as the boat hull assembly, the first longitudinal member and the second longitudinal member have a series of openings throughout the length of said longitudinal members, wherein said series of openings have a substantially circular profile shape, the series of openings are placed inline at a space apart relationship between each other, furthermore, the stepped keel includes vent tubes having a substantially cylindrical shape, said vent tubes are made of the same material as said first longitudinal member and said second longitudinal member, the vent tubes are mounted at an angle from zero to ninety degrees from said first longitudinal member and said second longitudinal member onto said series of openings, at least one vent tube of said vent tubes is mounted between one distal end of the first longitudinal member and another distal end of the second longitudinal member at a point where said first longitudinal member and said second longitudinal member meet.

12. A system for a ventilated boat keel, consisting of:

a) a boat hull assembly; and b) a boat keel assembly including a stepped keel having at least two longitudinal members, a first longitudinal member and a second longitudinal member running from a bow to a stern of the boat hull assembly, mounted inline, unevenly and in a descendent order, wherein a portion of one distal end of said first longitudinal member meets with a portion of another distal end of said second longitudinal member, said first longitudinal member and said second longitudinal member are made of the same material as the boat hull assembly, the first longitudinal member and the second longitudinal member have a series of openings throughout the length of said longitudinal members, wherein said series of openings have a substantially circular profile shape, the series of openings are placed inline at a space apart relationship between each other, furthermore, the stepped keel includes vent tubes having a substantially cylindrical shape, said vent tubes are made of the same material as said first longitudinal member and said second longitudinal member, the vent tubes are mounted at an angle from zero to ninety degrees from said first longitudinal member and said second longitudinal member onto said series of openings, at least one vent tube of said vent tubes is mounted between said one distal end of the first longitudinal member and said another distal end of the second longitudinal member at a point where said first longitudinal member and said second longitudinal member meet.

* * * * *